US009458689B2

(12) United States Patent
Mancuso et al.

(10) Patent No.: US 9,458,689 B2
(45) Date of Patent: Oct. 4, 2016

(54) SYSTEM FOR CONTROLLING IN-RISER FUNCTIONS FROM OUT-OF-RISER CONTROL SYSTEM

(71) Applicant: OneSubsea IP UK Limited, London (GB)

(72) Inventors: Michael Mancuso, Houston, TX (US); Chris Kocurek, Houston, TX (US)

(73) Assignee: OneSubsea IP UK Limited, London (GB)

( * ) Notice: Subject to any disclaimer, the term of this patent is extended or adjusted under 35 U.S.C. 154(b) by 4 days.

(21) Appl. No.: 14/186,824

(22) Filed: Feb. 21, 2014

(65) Prior Publication Data

US 2015/0240585 A1 Aug. 27, 2015

(51) Int. Cl.

| | |
|---|---|
| ***E21B 7/12*** | (2006.01) |
| ***E21B 33/035*** | (2006.01) |
| ***E21B 33/038*** | (2006.01) |
| ***E21B 33/064*** | (2006.01) |
| ***E21B 17/01*** | (2006.01) |

(52) U.S. Cl.

CPC ..... *E21B 33/0355* (2013.01); *E21B 17/01* (2013.01); *E21B 33/0385* (2013.01); *E21B 33/064* (2013.01)

(58) Field of Classification Search

CPC ..... E21B 33/035; E21B 34/045
USPC ..... 166/338, 351, 368; 682/338, 351, 368
See application file for complete search history.

(56) References Cited

U.S. PATENT DOCUMENTS 4,375,239 A 3/1983 Barrington et al.
5,819,852 A * 10/1998 Cunningham et al. ..... 166/345
5,941,310 A * 8/1999 Cunningham et al. ..... 166/345
6,026,905 A 2/2000 Garcia-Soule
6,102,124 A * 8/2000 Skeels ..... E21B 33/0355 166/347
6,253,854 B1 * 7/2001 Fenton ..... E21B 34/045 166/363
7,013,970 B2 * 3/2006 Collie et al. ..... 166/89.1
7,318,480 B2 * 1/2008 Hosie ..... E21B 33/035 166/255.2
8,336,629 B2 * 12/2012 Vaynshteyn ..... E21B 33/0355 166/344
2004/0074635 A1 * 4/2004 Collie et al. ..... 166/85.1
2008/0110633 A1 5/2008 Trewhella
2010/0276155 A1 11/2010 Niemeyer et al.
2011/0005770 A1 1/2011 Scranton et al.
2011/0079395 A1 4/2011 Vaynshteyn et al.
2011/0120722 A1 5/2011 Scranton et al.
2011/0137471 A1 6/2011 Dailey, Jr.
2011/0297387 A1 * 12/2011 Hart ..... 166/345
2012/0175126 A1 7/2012 Zeller
2013/0103208 A1 4/2013 Niemeyer
2013/0168101 A1 * 7/2013 Bryson et al. ..... 166/341

* cited by examiner

*Primary Examiner* — Matthew R Buck
*Assistant Examiner* — Aaron Lembo
(74) *Attorney, Agent, or Firm* — Chamberlain Hrdlicka

(57) ABSTRACT

A system for controlling a blowout preventer stack and subsea test tree connected to a subsea wellhead assembly, the system comprising: a marine riser engageable with the subsea wellhead assembly; a lower marine riser package configured to be attached to the marine riser in the subsea environment, wherein the blowout preventer is configured to be removably attached to the lower marine riser package; an umbilical located outside of the marine riser adapted to communicate control fluids, electrical signals and/or fiber optic communications to a subsea controller, wherein the subsea controller is configured to receive control fluids and/or signals from the umbilical and to provide functions to the blowout preventer stack and subsea test tree, further wherein the subsea controller stabs into the system above the subsea wellhead assembly. This out-of-marine riser design provides for simplification in design criteria associated with the subsea controller and umbilical system.

19 Claims, 5 Drawing Sheets

SYSTEM FOR CONTROLLING IN-RISER FUNCTIONS FROM OUT-OF-RISER CONTROL SYSTEM

BACKGROUND

Drilling and producing offshore oil and gas wells includes the use of offshore facilities for the exploitation of undersea petroleum and natural gas deposits. Offshore systems often include a marine riser which connects surface equipment to a blowout preventer stack which is connected to a subsea wellhead.

Offshore systems are frequently equipped for well testing operations and include a safety shut-in system which automatically prevents fluid communication between the subsea wellhead and the surface. A typical safety shut-in system comprises a subsea test tree which is lowered through the riser and landed inside the blowout preventer stack.

A subsea test tree typically includes one or more safety valves that can automatically shut-in a well in the event of an emergency, such as a natural disaster. Hydraulic, electrical and fiber optic communications to, inter alia, operate the valves and devices in a blowout preventer stack are communicated from a surface control system by way of an umbilical.

Normally, when a subsea test tree is utilized in subsea applications, the subsea test tree comprises a subsea controller (e.g., multiplex controller) and umbilical system lowered with the subsea test tree and contained wholly within the marine riser. The subsea controller and umbilical system serve to operate the subsea test tree. These in-marine riser systems must work for extended periods of time with multiple installation and removal cycles within the confined space of a blowout preventer.

In addition, due to containment within the marine riser, the subsea controller and umbilical system must be designed to withstand both the fluids and temperatures associated with the harsh in-riser environment. Due to the unforgiving conditions, the typical life span for the subsea controller and umbilical system is less than two years.

Accordingly, there exists a need for a subsea controller and umbilical system that does not subject the devices to the harsh in-marine riser conditions and still provides for appropriate hydraulic, electrical and fiber optic communications to the valves and devices within a blowout preventer stack, including a subsea test tree.

SUMMARY

Disclosed is a system for controlling a blowout preventer stack and subsea test tree connected to a subsea wellhead assembly. The system includes a marine riser attachable to a lower marine riser package ("LMRP"), which is removably attached with the blowout preventer stack. An umbilical located outside of the marine riser communicates control fluids, electrical signals and/or fiber optic communications to a subsea controller. The subsea controller receives the control fluids and/or signals from the umbilical and controls the subsea test tree. The subsea controller ties into the drilling system above the subsea wellhead assembly by way of a function spool and corresponding stab plate.

The subsea controller and umbilical system are located in the out-of-marine riser environment, which provides substantial benefits. In particular, the out-of-marine riser design provides for simplification in design criteria associated with the subsea controller and umbilical system. Specifically, the devices incur reduced temperature, harsh fluid exposure, and marine riser loading and unloading.

Further, by removing the subsea controller and umbilical systems from the interior of the marine riser, the devices are no longer dependent on the diameter of the marine riser and can be designed larger or smaller depending on needs. Moving the subsea controller and umbilical system outside of the marine riser extends the lifespan of these components.

DRAWINGS

For a detailed description of the preferred embodiments of the invention, reference will now be made to the accompanying drawings in which.

DETAILED DESCRIPTION

Figure 1:
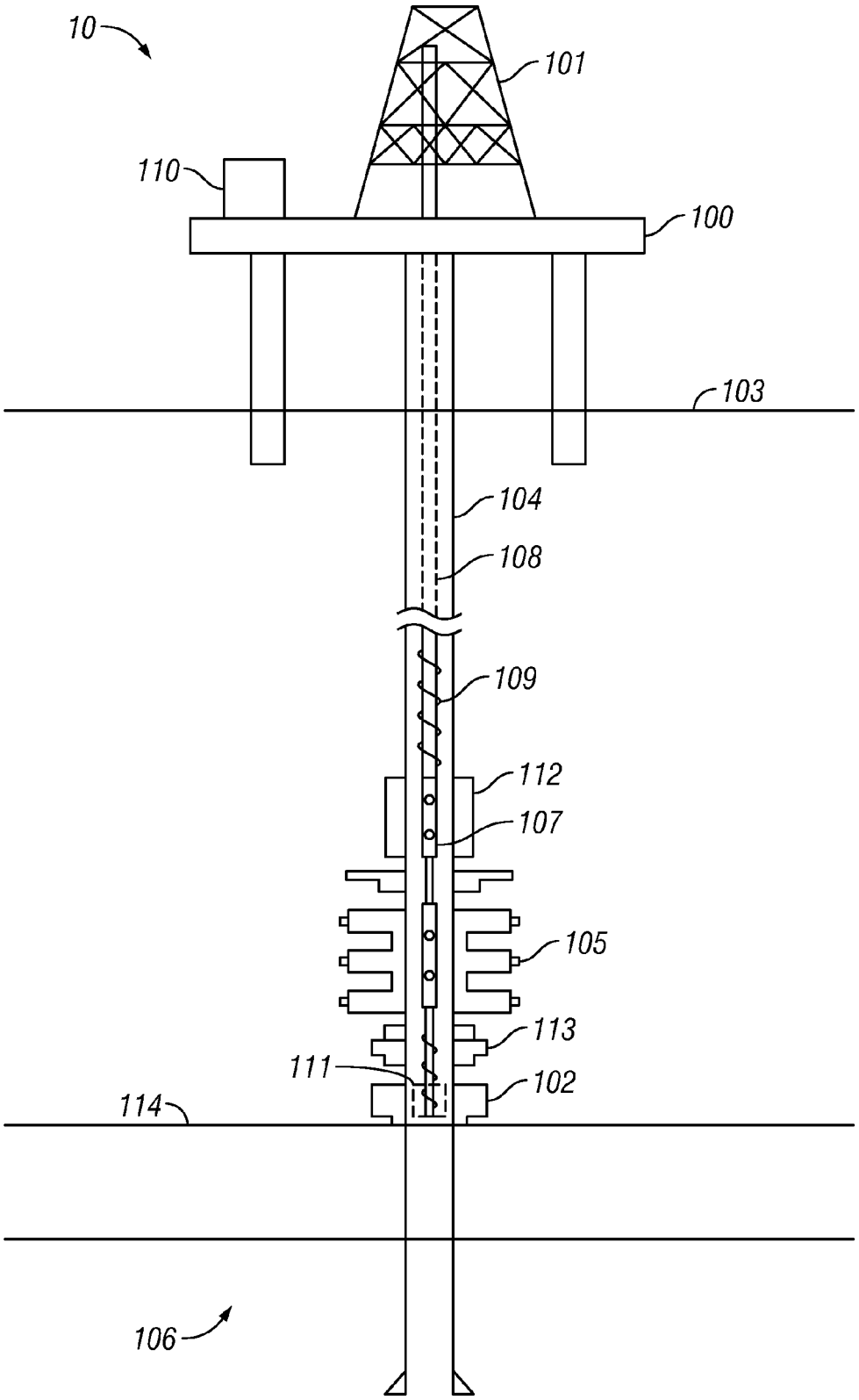
FIG. 1 shows a prior art schematic depicting a subsea control system utilizing an in-marine riser umbilical and in-marine riser control module.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. In the following discussion and in the claims, the terms "including" and "comprising" are used in an open-ended fashion, and thus should be interpreted to mean "including, but not limited to . . . " The use of "top," "bottom," "above," "below," and variations of these terms is made for convenience, but does not require any particular orientation of the components.

Figure 2:
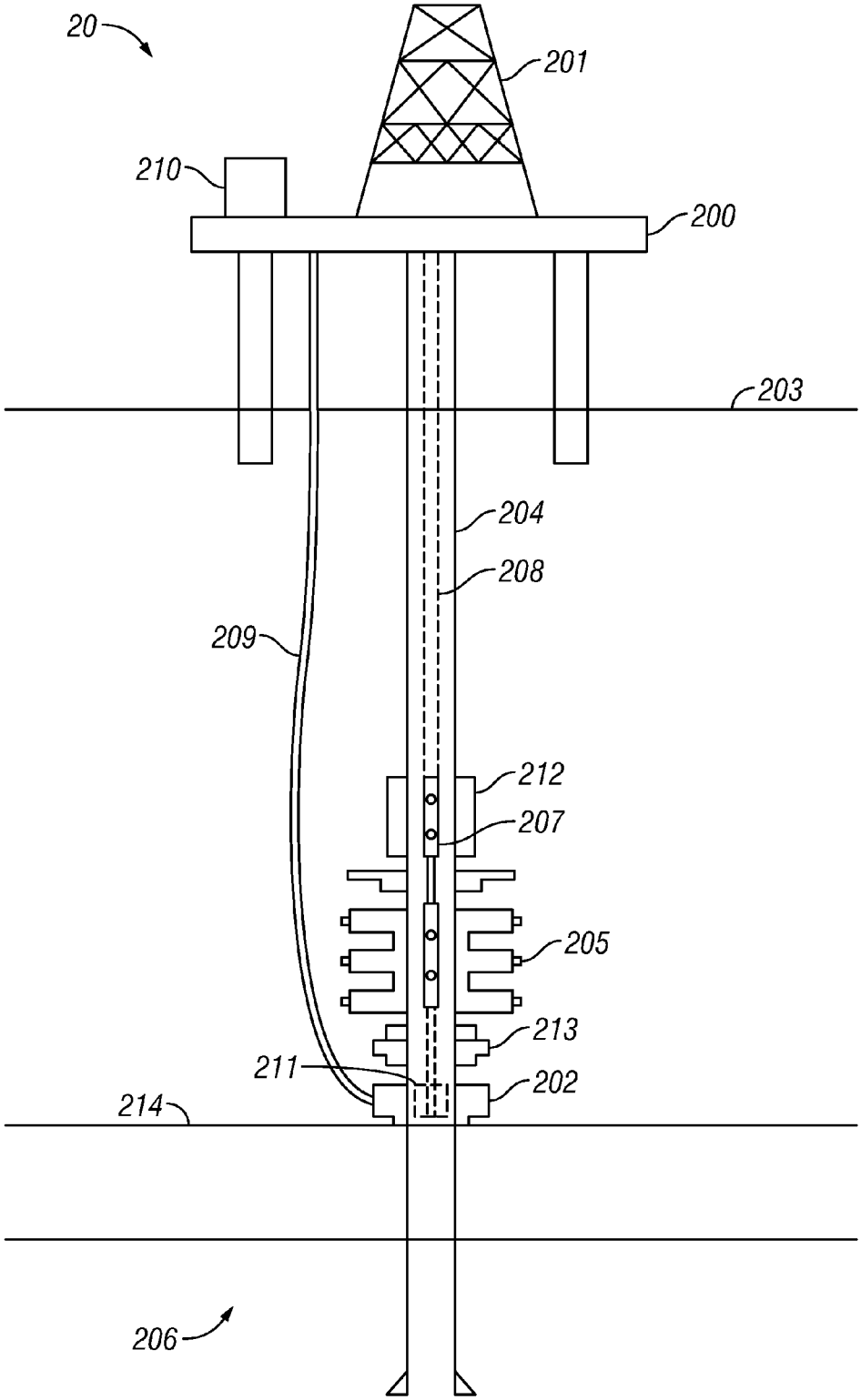
FIG. 2 shows a prior art schematic depicting a subsea control system utilizing an out-of-marine riser umbilical and in-marine riser control module.

Referring now to FIGS. 1 and 2, schematic views of two embodiments of a prior art offshore drilling system 10 are shown. The prior art drilling system 10 comprises an offshore drilling platform 100 on or above a water surface 103 equipped with a derrick 101 and positioned over a subsea wellhead assembly 102. The offshore platform may be an offshore floating platform, an anchored vessel or even a jack-up type of platform.

A marine riser 104 extends from the platform 100 to a lower marine riser package 112 ("LMRP"). A typical LMRP consists of a ball/flex joint coupled to the marine riser, marine riser adapter, kill and auxiliary lines and subsea control modules. The lower marine riser package 112 is operatively connected to a blowout preventer stack 105 ("BOP stack"). A typical BOP stack consists of one or more preventers, spools, valves, and nipples. The BOP stack 105 is operatively connected to a subsea wellhead assembly 102 which is, in turn, operatively connected to a subterranean well 106.

The prior art drilling system illustrated in FIG. 1 also includes a subsea test tree 107 ("SSTT"). A subsea test tree typically includes one or more safety valves that can shut-in a well in the event the platform 100 needs to be disengaged from the well 106. As illustrated in prior art FIG. 1, the SSTT 107 is landed in the BOP stack 105 by way of the landing string 108 which is disposed within the marine riser 104.

During operation, hydraulic, electrical and/or fiber optic communications are provided from a surface control system 110 to control actuatable devices in the BOP stack, including the SSTT 107. The surface control system 110 is configured to provide hydraulic pressure feeding various hydraulically operated devices, such as valves in the SSTT. The surface control system 110 can also regulate and supply electrical signals to feed various electrically operated devices, such as latches in SSTT.

The surface control system 110 will also generally include a means for conveying hydraulic, electrical and/or fiber optic communications, such as an umbilical 109 extending from the surface control system 110 to the subsea equipment to be controlled. As illustrated in prior art FIG. 1, the umbilical 109 can be coupled to the landing string 108 and, accordingly, disposed within the marine riser 104. Alternatively, as illustrated in prior art FIG. 2, the umbilical 209 can be external to the marine riser 204 in open water. In either prior art embodiment, unlike the present invention, the umbilical 109, 209 ties into the drilling system 10, 20 at the subsea wellhead assembly 102, 202 or production tree 113, 213, but below the BOP stack 105, 205.

As illustrated in prior art FIGS. 1 and 2, a subsea controller 111, 211 is located at the subsea wellhead assembly 102, 202 inside drilling system 10, 20. The subsea controller 111, 211 could also be located at a subsea production tree 113, 213, below the blowout preventer 105, 205 and subsea test tree 107, 207. Because the subsea controller 111, 211 is located in the drilling system 10, 20, movement between the physical components (e.g., marine riser 104, 204, subsea test tree 107, 207, retainer valves, etc.) and the sea currents may cause damage to the umbilical 109, 209 system and subsea controller 111, 211, thus reducing the useful life of the system.

Figure 3:
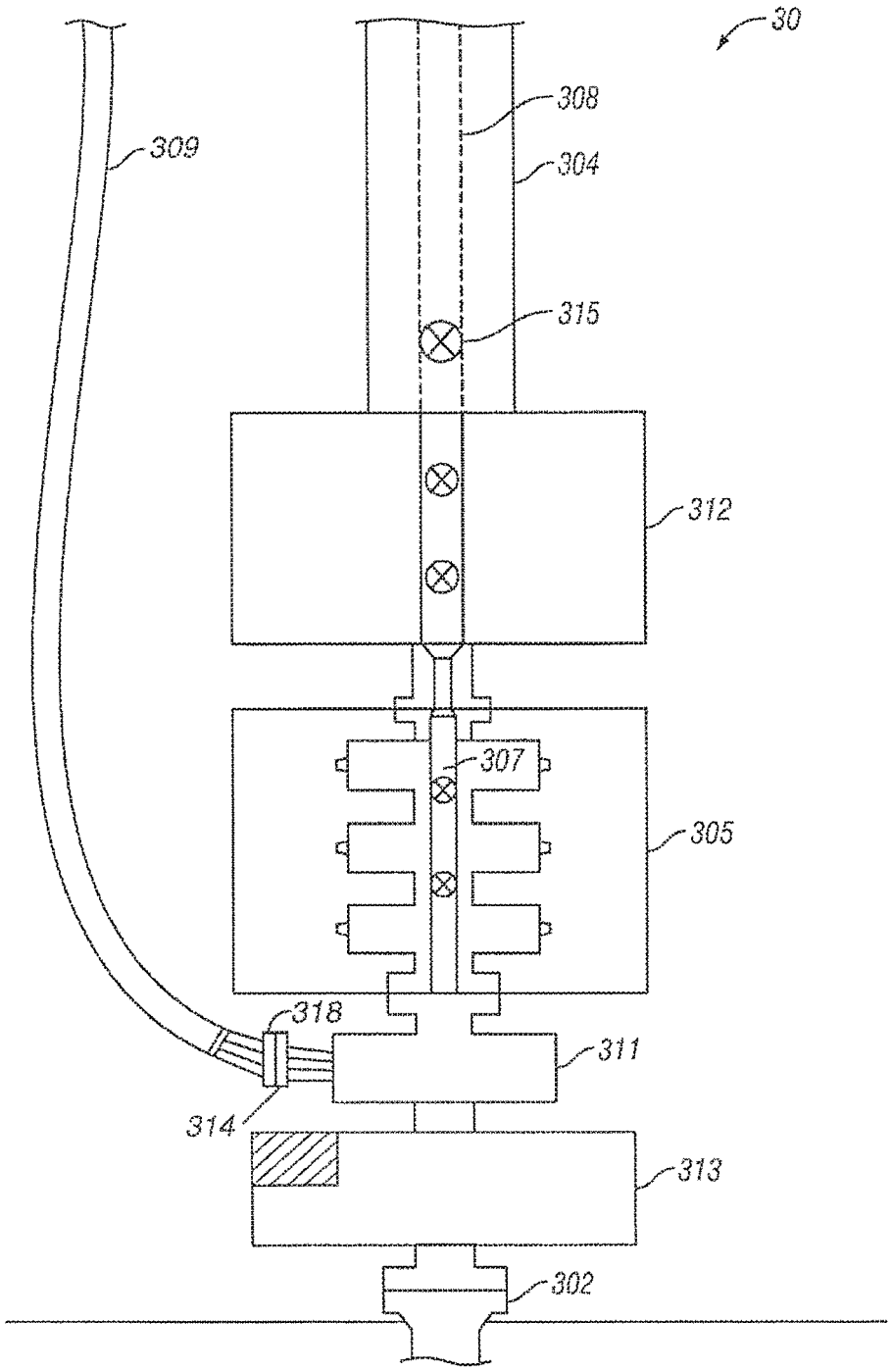
FIG. 3 shows one embodiment of the present invention depicting a subsea control system for controlling a subsea test tree utilizing an out-of-marine riser umbilical and out-of-marine riser control module wherein the subsea controller ties into a function spool located below the blowout preventer.

Referring to FIG. 3, one embodiment of the present invention as part of a drilling system 30 is shown. As seen in FIG. 3, a SSTT 307 is located within a BOP stack 305, below a LMRP 312. The SSTT 307 provides well isolation and latch and unlatch functionality, as well as hydrocarbon retention when conditions on the platform above and/or in the well below the subsea wellhead assembly 302 deviate from preset limits. This allows the floating platform (not shown in FIG. 3) to relocate if needed by disengaging the riser 304 from the well.

The SSTT 307 is landed in the BOP stack 305 on landing string 308 through marine riser 304. The SSTT 307 may include a valve assembly comprising safety valves and latches. The safety valves may act as master control valves during testing of the well. The latch allows an upper portion of landing string 308 to be disconnected from the SSTT 307 if desired. The BOP stack 305 may include one or more ram preventers and one or more annular preventers. The embodiments are not limited to the particular embodiments of SSTT 307 and BOP stack 305 shown in FIGS. 3-5, but any other combination of electrically powered valves and preventers that control flow of formation fluids through the landing string 308 may also be used. For instance, a single preventer could be used rather than a BOP stack. Further, the safety valves could comprise, e.g., flapper valves and ball valves.

A retainer valve 315 is arranged on the landing string 308 to prevent fluid in an upper portion of the landing string 308 from draining into the riser 304 when disconnected from the SSTT 307. An out-of-riser umbilical 309 provides a path for conveying the electrical power for operating the SSTT 307 and retainer valve 315. The out-of-riser umbilical 309 also provides a path for connecting a surface operator/control system (such as for example surface control system 210 in FIG. 2) to the subsea controller 318. The subsea controller 318 can include a control circuit and other electrical elements such as subsea telemetry boards, a power regulator and a battery. These other electrical elements are not shown in the exemplary embodiments in the Figures, but are commonly known to those of ordinary skill in the art.

As noted above with regard to the prior art, subsea test trees traditionally relied on control fluids and/or electrical signals supplied from an in-marine riser control system. As seen in the embodiment shown in FIG. 3, the umbilical system 309 and subsea controller 318 supplying control fluids and/or electrical signals are located outside the marine riser 304 and stab into a function spool 311 located above the subsea wellhead assembly 302, but below the blowout preventer stack 305. The subsea controller 318 is operatively and removably coupled to the system 30 by way of the function spool 311 located above the subsea wellhead 302. In FIG. 3, the function spool 311 is located above the subsea production tree 313. The function spool 311 includes a stab plate 314 which includes a series of fluid connectors hydraulically connectable to the subsea controller 318 and out-of-riser umbilical 309. Each of the fluid connectors includes a check valve that prevents fluid expulsion from the connectors while the connectors are disengaged, and allows bidirectional fluid flow while the connectors are engaged. The subsea controller 318 and umbilical 309 contain similar fluid connectors mateable with the stab plate 314. When the subsea controller 318 and stab plate 314 are mated, the subsea controller 318 can provide hydraulic fluids and control signals to operate any actuatable devices in the BOP stack 305, including the SSTT 307. More detail on the function spool is explained below.

Figure 4:
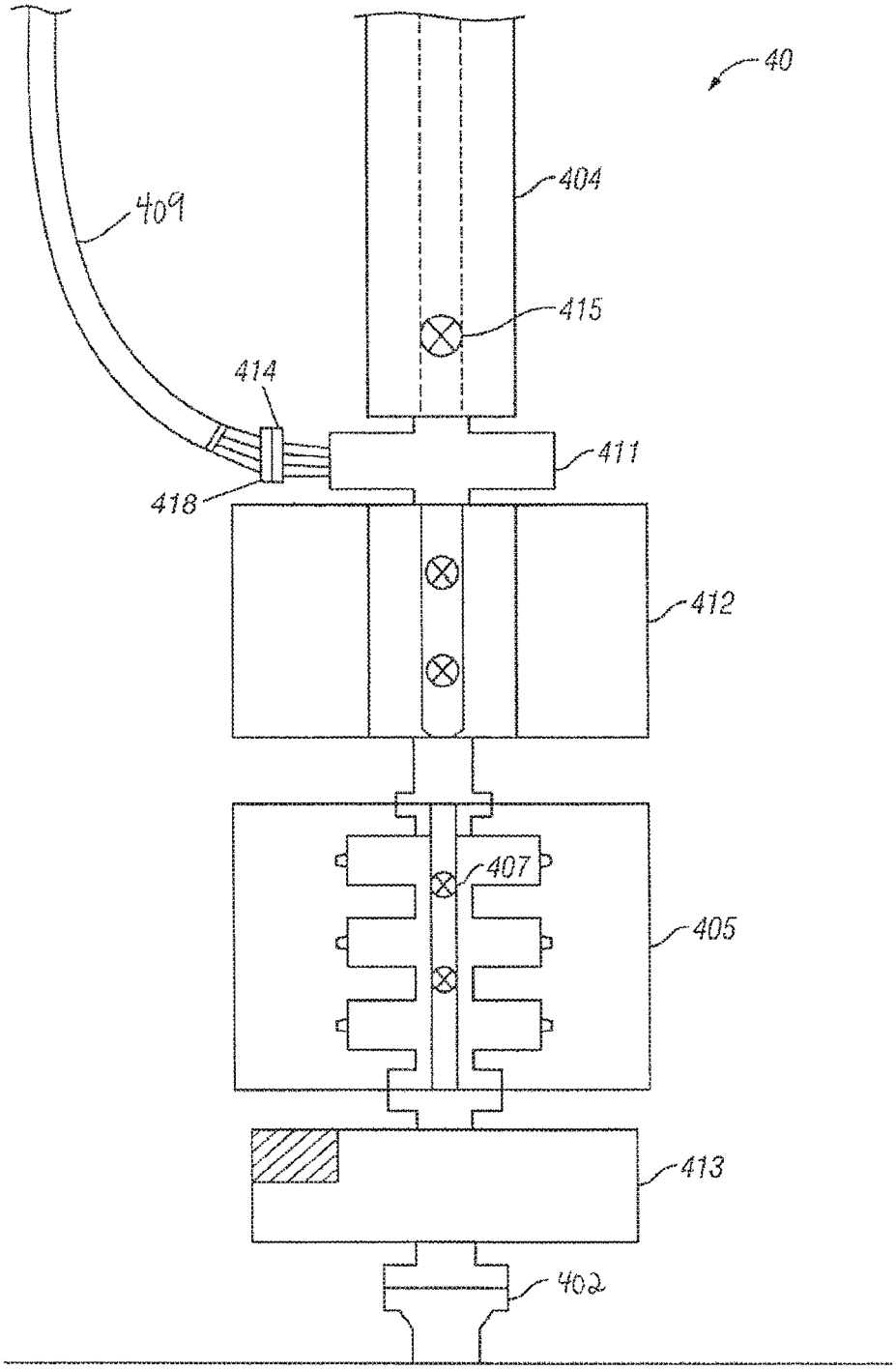
FIG. 4 shows another embodiment of the present invention depicting a subsea control system for controlling a subsea test tree utilizing an out-of-marine riser umbilical and out-of-marine riser control module wherein the subsea controller ties into a function spool located above the blowout preventer.

Referring now to FIG. 4, another embodiment of the present invention as part of a drilling system 40 is illustrated in which the umbilical system 409 and subsea controller 418 supplying control fluids and/or electrical signals are located outside the marine riser 404 and stab into a function spool 411 located above the lower marine riser package 412.

The subsea controller 418 is operatively and removably coupled to the system 40 by way of the function spool 411 located above the subsea wellhead 402. In the embodiment in FIG. 4, the function spool 411 is located above the BOP stack 405. The function spool 411 includes a stab plate 414 which includes a series of fluid connectors hydraulically connectable to the subsea controller 418 and out-of-riser umbilical 409. Each of the fluid connectors includes a check valve that prevents fluid expulsion from the connectors while the connectors are disengaged, and allows bidirectional fluid flow while the connectors are engaged. The subsea controller 418 and the umbilical 409 contain similar fluid connectors mateable with the stab plate 414. When the subsea controller 418 and stab plate 414 are mated, the subsea controller 418 can provide hydraulic fluids and control signals to operate any actuatable devices in the blowout preventer stack 405, including the subsea test tree 407.

Figure 5:
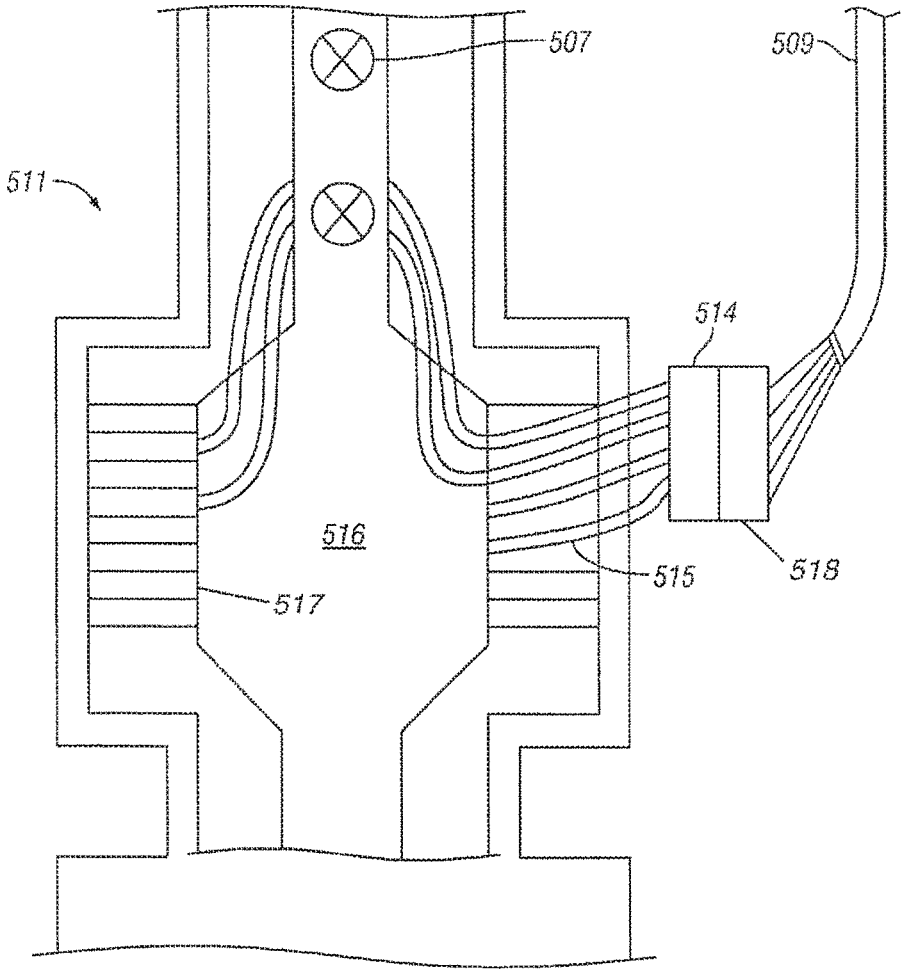
FIG. 5 shows a detailed view of the function spool illustrated in FIGS. 3 and 4.

Referring to FIG. 5, the out-of-riser umbilical 509 and subsea controller 518 mate with the function spool 511 to provide hydraulic fluids and/or electrical signals to the subsea test tree 507. Hydraulic fluid is delivered to the function spool 511 via the stab plate 514 and through galleries 515 that provide fluid paths to the drilling system through the functional spool 511. From there, internal porting 516 delivers the control fluids to the subsea test tree 507. The galleries 515 are disposed between a sealing surface 517 within the function spool 511. Electrical conduits may be used for transmitting electrical signals to the subsea test tree 507.

What is claimed is:

1. A system for use with subsea well equipment including a lower marine riser package, a subsea blowout preventer stack, and a subsea production tree in fluid communication with a subsea wellhead assembly and a marine riser, the system comprising:

a function spool locatable above the subsea wellhead assembly and separable from the subsea production tree, the function spool comprising a connector outside of the function spool;

a subsea test tree transportable through the marine riser on a landing string and placeable into at least one of the lower marine riser package and the blowout preventer stack;

a surface control system;

a communication umbilical in communication with the surface control system and locatable outside of the marine riser, the communication umbilical configured to connect with the function spool connector;

the subsea test tree being configured to establish control communication with the communication umbilical through the function spool without rotational orientation of the landing string; and wherein the surface control system is configured to control the subsea test tree through the function spool.

2. The system as recited in claim 1, wherein the function spool and the surface control system are located below the blowout preventer stack.

3. The system as recited in claim 1, wherein the function spool and the surface control system are located above the lower marine riser package.

4. The system as recited in claim 1, wherein the subsea production tree is located above the subsea wellhead assembly and wherein the function spool is separable from the subsea production tree.

5. The system as recited in claim 1, wherein the surface control system communicates with the subsea test tree from above the subsea test tree.

6. The system as recited in claim 1, wherein the surface control system communicates with the subsea test tree from below the subsea test tree.

7. The system as recited in claim 1, wherein the function spool comprises a stab plate comprising a plurality of fluid connectors mateable with the surface control system and communication umbilical.

8. The system as recited in claim 1, wherein the surface control system provides commands to control the subsea test tree through the communication umbilical.

9. The system as recited in claim 1, wherein the subsea test tree is placed in the lower marine riser package and the blowout preventer stack.

10. A method of operating subsea well equipment for a subsea well including a subsea wellhead assembly, the method comprising:

connecting with the subsea well using a marine riser, a lower marine riser package, and a blowout preventer stack;

transporting a subsea test tree through the marine riser on a landing string and into at least one of the lower marine riser package and the blowout preventer stack;

connecting a communication umbilical with a function spool connector of a function spool locatable above the subsea wellhead assembly, the communication umbilical being in communication with a surface control system;

establishing communication with the subsea test tree above the subsea wellhead assembly with the communication umbilical through the function spool without rotational orientation of the landing string; and controlling the subsea test tree through the function spool, outside of the riser, the lower marine riser package, and the blowout preventer stack, and above the subsea wellhead assembly using the subsea control system.

11. The method of claim 10, wherein the establishing communication with the subsea test tree comprises establishing at least one of electric and hydraulic communication.

12. The method of claim 10, further comprising sending commands from a surface to the surface control system.

13. The method of claim 10, wherein the establishing communication with the subsea test tree comprises establishing communication above the subsea test tree with the communication umbilical.

14. The method of claim 10, wherein the establishing communication with the subsea test tree comprises establishing communication below the subsea test tree with the communication umbilical.

15. The method of claim 10, wherein the establishing communication with the subsea test tree comprises establishing communication apart from a subsea production tree with the communication umbilical.

16. The method of claim 10, wherein the establishing communication with the subsea tree with the communication umbilical comprises connecting with the subsea test tree through a wall of the function spool.

17. The method of claim 10, wherein the subsea test tree is placed into both the lower marine riser package and the blowout preventer stack.

18. The method of claim 10, further comprising closing fluid communication through an inner bore of the subsea test tree.

19. The method of claim 18, further comprising disconnecting the landing string from the subsea test tree and disconnecting the marine riser from the lower marine riser package with the subsea test tree still in at least one of the lower marine riser package and the blowout preventer stack.

* * * * *